United States Patent [19]

Winkler et al.

[11] 4,282,014

[45] Aug. 4, 1981

[54] DETECTOR FOR DETECTING VOLTAGE BREAKDOWNS ON THE HIGH-VOLTAGE SIDE OF AN ELECTRIC PRECIPITATOR

[75] Inventors: Heinrich Winkler, Nuremberg; Gerhard Rumold, Bubenreuth; Helmut Schummer, Heusenstamm, all of Fed. Rep. of Germany

[73] Assignee: Siemens Aktiengesellschaft, Berlin and Munich, Fed. Rep. of Germany

[21] Appl. No.: 40,525

[22] Filed: May 21, 1979

Related U.S. Application Data

[63] Continuation of Ser. No. 870,627, Jan. 19, 1978, abandoned.

[30] Foreign Application Priority Data

Sep. 9, 1975 [DE] Fed. Rep. of Germany ..... 2504084

[51] Int. Cl.[3] ..... B03C 3/66

[52] U.S. Cl. ..... 55/105; 55/139; 307/351; 328/151

[58] Field of Search ..... 55/105, 139; 307/358, 307/359, 351; 328/151

[56] References Cited

U.S. PATENT DOCUMENTS

| | | | |
|---|---|---|---|
| 3,413,491 | 11/1968 | Reeves et al. | 307/351 |
| 3,602,805 | 8/1971 | Vukosovic | 55/105 |
| 3,654,561 | 4/1972 | Egawa et al. | 328/151 |
| 3,745,749 | 7/1973 | Gelfand | 55/105 |
| 3,772,853 | 11/1973 | Burge et al. | 323/24 |
| 3,959,715 | 5/1976 | Canning | 55/105 |
| 3,981,695 | 9/1976 | Fuchs | 55/139 |
| 4,138,232 | 2/1979 | Winkler et al. | 55/105 |
| 4,152,124 | 5/1979 | Davis | 55/105 |

OTHER PUBLICATIONS

Goller et al.-Electric-Filter Control with Direct Breakdown Detection, Seimens-Zeitschrift (1971) pp. 567-572.

*Primary Examiner*—Bernard Nozick
*Attorney, Agent, or Firm*—Kenyon & Kenyon

[57] ABSTRACT

A detector for detecting breakdowns on the high-voltage side of an electric precipitator, the voltage of which is supplied from an a-c network through a thyristor control circuit, a high-voltage transformer and a rectifier. The improvement of the invention comprises means for continuously comparing characteristic parameters of successive half-waves of variations of the voltage at the precipitator. A predetermined deviation of the characteristic parameters comprises a criterion for determining a breakdown of the precipitator voltage.

4 Claims, 6 Drawing Figures

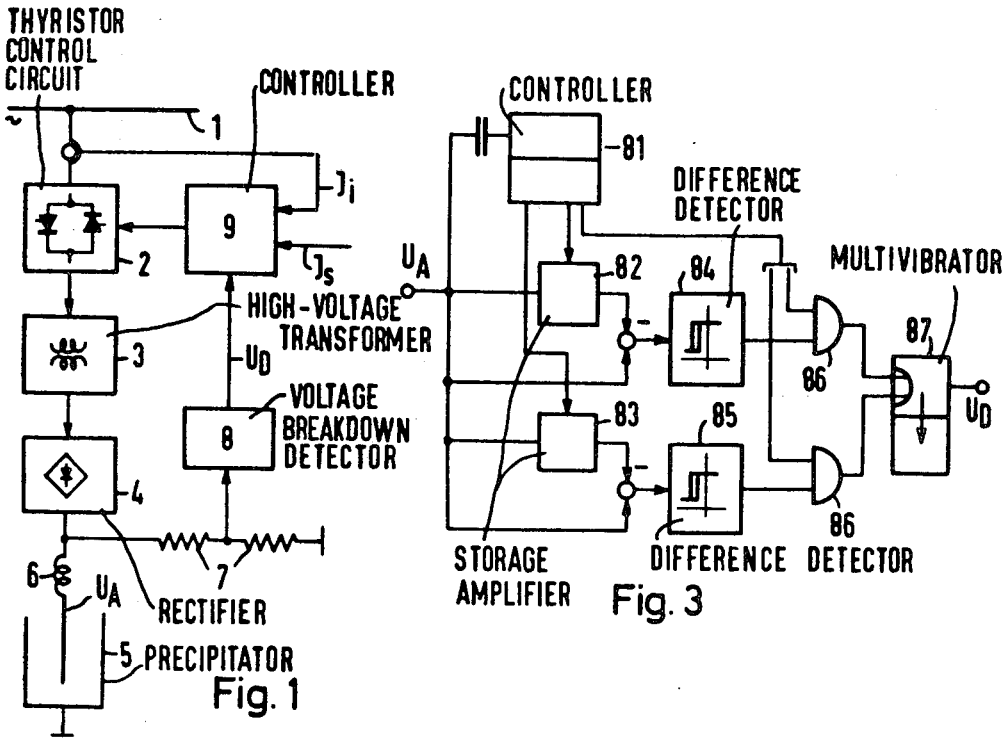
Fig. 1
Fig. 3
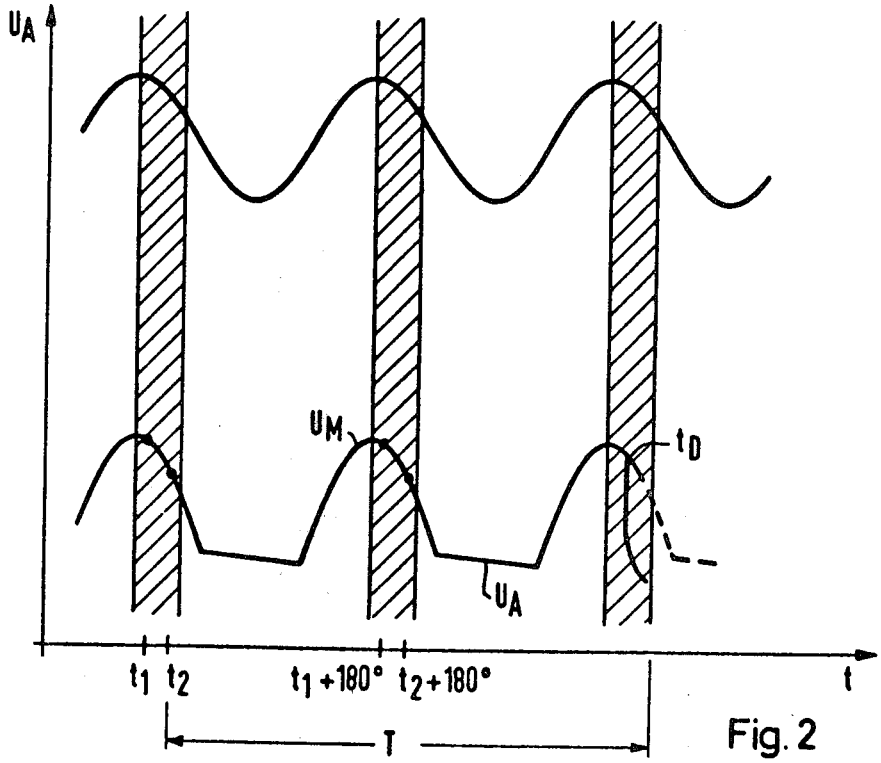
Fig. 2

DETECTOR FOR DETECTING VOLTAGE BREAKDOWNS ON THE HIGH-VOLTAGE SIDE OF AN ELECTRIC PRECIPITATOR

This is a continuation of application Ser. No. 870,627 filed Jan. 19, 1978, now abandoned.

BACKGROUND OF THE INVENTION

1. Field of the Invention

The present invention relates to a detector for detecting voltage breakdowns on the high-voltage side of an electric precipitator, the voltage of which is supplied from an a-c network through a thyristor control circuit, a high-voltage transformer, and a recitfier.

2. Description of the Prior Art

Detectors of the above-described type are known in the art (see, for example, Siemens-Zeitschrift (1971), pp. 567–572), and are used in electric precipitators. In such precipitators, the applied d-c voltage is slowly and gradually increased up to a voltage level at which a breakdown in the precipitator gap occurs. When such a voltage breakdown occurs, the voltage at the precipitator decreases immediately. After a voltage breakdown, the drive voltage for the single-phase thyristor control circuit on the a-c side must be quickly reduced. If it is not reduced, a current of large magnitude would flow through the ionized gap of the precipitator during the next half-wave of the precipitator voltage, which is undesirable. After the drive voltage is reduced, the precipitator voltage is slowly increased back up to its breakdown level.

The slope of the decrease of the precipitator voltage measured during the breakdown of the voltage at the precipitator can be used as the criterion for determining a precipitator breakdown. The voltage slopes which are present during normal operation of the precipitator due to the variation of the precipitator voltage must, however, be substantially lower in order to do so. It should be noted that the high-voltage rectifier of such a detector generally comprises a two-pulse rectifier, and that the electric precipitator is a considerable ohmic load due to its corona discharge. As a result, the precipitator gap voltages exhibit corresponding harmonics, and the waveform shape of the voltage will depend upon the precipitator design, the matter which is to be precipitated, and the size of the precipitator installation, particularly during operation at a low breakdown voltage. For these reasons, measurement of the voltage slopes during normal precipitator operation and during a voltage breakdown must be carried out in different precipitator installations and under different operating conditions in order to obtain accurate criteria for detecting a breakdown by measurement of the voltage slopes.

SUMMARY OF THE INVENTION

It is therefore an object of the present invention to provide an improved detector for detecting a voltage breakdown on the high-voltage side of an electric precipitator which permits a voltage breakdown in the precipitator to be detected independently of data related to the precipitator installation.

These and other objects of the invention are achieved in a detector for detecting breakdowns on the high-voltage side of an electric precipitator, the voltage of which is supplied from an a-c network through a thyristor control circuit, a high-voltage transformer and a rectifier. The improvement of the invention comprises the provision of means for comparing characteristic parameters of successive half-waves of variations of the voltage at the precipitator. A predetermined deviation of the characteristic parameters comprises a criterion for determining a breakdown of the precipitator voltage. Detection of the breakdown of the precipitator voltage can be determined independently of installation-related data in such an arrangement since the reference standard is continuously adapted to the conditions in the precipitator.

Precipitator voltage breakdowns usually occur after the voltage waveform reaches a maximum. Thus, it is sufficient in many instances to compare the respective voltage waveforms after each amplitude maximum of the precipitator voltage occurs. In order to effect such a comparison, the detector may include means for measuring the precipitator voltage at selected points in time as the precipitator voltage waveform decreases from such maxima, means, coupled to the measuring means, for storing the voltage values measured, and means, coupled to the storing means, for comparing the voltage values measured with the measured voltage values of a succeeding half-wave at corresponding later points in time shifted by one period of the precipitator voltage signal. If there is a considerable deviation when the voltage values are compared, this can be used as a criterion for determining and indicating a voltage breakdown.

In a preferred embodiment of the invention, the means for storing the voltages measured may comprise storage amplifiers, the output terminals of which are coupled to difference detectors and to which detectors the filter gap voltage is also transmitted. A simple circuit variation is obtained by using a storage amplifier coupled in parallel relationship to a linear amplifier. In such a circuit, the precipitator voltage is transmitted to the amplifiers and a voltage breakdown signal is generated when a predetermined difference exists between the output voltages of the amplifiers.

These and other objects of the invention will be described in greater detail in the following detailed description.

BRIEF DESCRIPTION OF THE DRAWINGS

In the drawings, wherein similar reference numerals denote similar elements throughout the several views thereof:

FIG. 1 is a schematic electrical diagram of an apparatus for detecting a voltage breakdown on the high-voltage side of an electric precipitator constructed according to the invention;

FIG. 2 is a graphical illustration of the waveform of the precipitator voltage in an electric precipitator constructed according to the invention;

FIG. 3 is one embodiment of a circuit for detecting voltage breakdowns in an electric precipitator constructed according to the invention;

DETAILED DESCRIPTION

Figure 4:
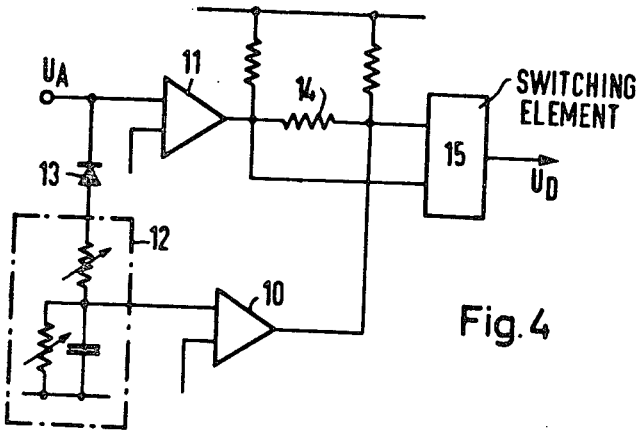
FIG. 4 is another embodiment of a circuit for detecting voltage breakdowns in an electric precipitator constructed according to the invention.

Referring now to the drawings, there is shown in FIG. 1 an electric precipitator 5 to which an a-c voltage signal $U_A$ is transmitted from an a-c network 1 through a thyristor control circuit 2, a high-voltage transformer 3, a rectifier 4, and a choke 6. A control device 9 is provided for driving the thyristor control circuit and generates control signals in response to an actual current value signal $I_i$ and a desired current value signal $I_s$. Control device 9 effects current-dependent control of the precipitator voltage.

The breakdown of the voltage at a precipitator 5 is detected on the high-voltage side of the precipitator. Specifically, precipitator voltage $U_A$ is detected on the high-voltage side of the precipitator by means of a pair of series-coupled resistors 7 and is evaluated in a voltage breakdown detector 8 coupled to the resistors. When a voltage breakdown occurs, a control signal $U_D$ is generated and transmitted to control device 9 from detector 8 which causes control device 9 to reduce the precipitator voltage by driving thyristor control circuit 2 and permitting the voltage to rise slowly again.

FIG. 2 graphically illustrates two waveforms of the precipitator voltage, one of which occurs during operation at a high breakdown voltage and the other of which occurs during operation at a low breakdown voltage. The voltage $U_A$ is present at the precipitator and varies over time with a period T. The area of each precipitator voltage waveform which is shaded always follows the amplitude $U_M$ and is utilized to monitor voltage breakdowns. If the voltage waveforms of succeeding half-waves of the precipitator voltage correspond in the shaded waveform areas, it can be assumed that the precipitator is operating normally. If, however, the voltage waveforms deviate from one another, such as, for example, when a voltage breakdown occurs as a result of a discharge at a time $t_D$, it can be assumed that there is a breakdown in the precipitator. In order to detect a breakdown, it is not necessary that the entire area of each of the shaded waveform areas to be compared to each other. It is, rather, sufficient if two or three characteristic waveform points are selected and are subsequently compared to corresponding values of the next precipitator voltage half-wave at a point shifted in phase through 180°el. Thus, the waveform points at $t_1$ and $t_2$ are compared with the waveform points at $t_1+180°$ and $t_2+180°$, and the difference compared with a predetermined deviation of the points selected as the criterion for a breakdown, in order to determine if a breakdown has occurred, A circuit for evaluating the characteristic waveform points is illustrated in FIG. 3 and includes a control unit 81 which cyclically operates according to the frequency of the precipitator voltage variations. The control unit opens, at $t_1$, a storage amplifier 82, which may comprise, for example, a capacitive storage device. The measured value of precipitator voltage $U_A$ at $t_1$ is then stored in storage amplifier 82. Similarly, the measured precipitator voltage value at $t_2$ is stored in another storage amplifier 83, which may also comprise a capacitive storage device. At $t_1+180°$, the voltage value in storage amplifier 82 is compared with the precipitator voltage transmitted to amplifier 82 at $t_1+180°$ by the difference detector 84 and AND gate 86 is released. If there is a deviation between the two values, a multivibrator 87 coupled to AND gate 86 generates control signal $U_D$ after a predetermined period of time and transmits the signal to control device 9 to signal a breakdown in a precipitator. The same operations are carried out at $t_2$ and $t_2+180°$, i.e., the measured precipitator voltage values are stored in storage amplifier 83 and are compared in difference detector 85. The control unit 81 and storage amplifiers 82 and 83 are preferably designed so that after each comparison operation, the measured voltage value stored in the storage amplifiers is erased and replaced by the then-existing precipitator voltage so that the comparison reference standards in the storage amplifiers are current. The synchronization of the control unit with the harmonics of the voltage signal can be achieved, for example, by synchronization with the firing pulses for the thyristor control circuit.

A simplified circuit is illustrated in FIG. 4 in which a voltage which is proportional to precipitator voltage $U_A$ is transmitted once directly to a linear amplifier 11 and once through a diode 13 to a storage amplifier 10 coupled in parallel relationship to amplifier 11. The input terminal of amplifier 10 is coupled to an R-C circuit 12 which functions as an integrator, and when R-C circuit 12 is properly adjusted, the output voltage of amplifiers 10 and 11 follows the instantaneous waveform shape of precipitator voltage $U_A$. During normal variation of the precipitator voltage, the voltage difference at a resistor 14 connected between the output terminals of the amplifiers is not sufficient to trigger a switching element 15 coupled to the resistor. When, however, the precipitator voltage collapses in a half-wave as a result of a voltage breakdown, amplifier 11 immediately generates an output signal. Amplifier 10, however, still has at its output terminal the maximum voltage resulting from the previous voltage half-wave due to the storage characteristic of R-C circuit 12. The relatively large voltage difference at resistor 14 can then be used as the voltage breakdown criterion.

Figure 5:
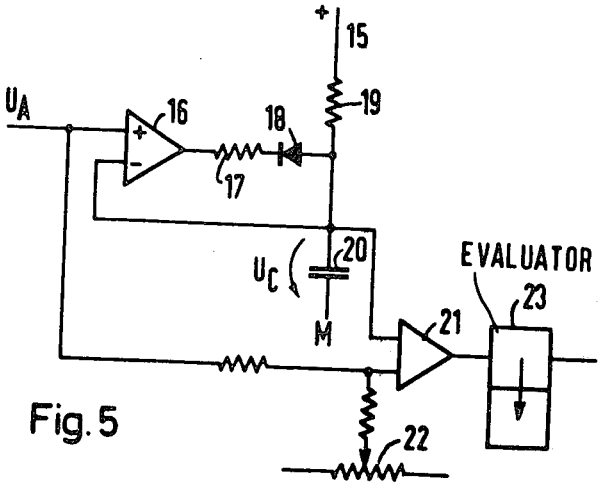
FIG. 5 is a further embodiment of a circuit for detecting voltage breakdowns in an electric precipitator constructed according to the invention.
Figure 6:
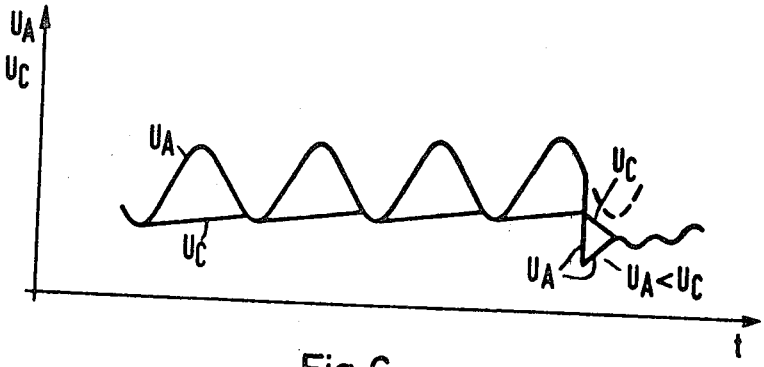
FIG. 6 is a graphical illustration of the waveforms of the precipitator voltage in the circuit illustrated in FIG. 5.

FIG. 5 is an illustration of a breakdown detection circuit including a device for storing the minimum value of the periodical precipitator voltage during continuous operation, the corresponding voltage waveforms of which are illustrated in FIG. 6. The circuit includes an amplifier 16, resistors 17 and 19, a capacitor 20, and a diode 18 and comprises a storage device for the minimum value of precipitator voltage $U_A$. If precipitator voltage $U_A$ is greater than $U_C$, which is the voltage at capacitor 20, then the output of amplifier 16 will be greater than 10 volts and diode 18 is switched off. The capacitor 20 is then slowly charged by means of resistor 19 at a charging rate which corresponds to the maximum rate of rise of precipitator voltage $U_A$. If the precipitator voltage $U_A$ is less than capacitor voltage $U_C$, the output of amplifier 16 decreases to less than −10 volts. Capacitor 20 is then discharged by resistor 17 and diode 18 at a relatively rapid rate to the minimum value of capacitor voltage $U_A$.

Whenever there is no precipitator voltage breakdown, precipitator voltage $U_A$ is always equal to capacitor voltage $U_C$. When a breakdown occurs, the precipitator voltage is less than the capacitor voltage for a short period of time since resistor 17 prevents a rapid, uncontrolled discharge of capacitor 20. A threshold voltage value can be set by means of a potentiometer 22 so that a breakdown signal is generated by a comparator 21 coupled to the capacitor and the potentiometer and is transmitted to an evaluator 23 only when the precipitator voltage is less than capacitor voltage $U_C$ by a predetermined amount. This threshold value may be made dependent upon capacitor voltage $U_C$.

The slope of the voltage variations of the capacitor voltage $U_C$ depends upon the precipitator voltage $U_A$. This dependency may be eliminated, however, by using constant-current sources, such as, for example, transistors including emitter resistors and Zener diodes, instead of resistors 17 and 19.

In the foregoing, the invention has been described with reference to specific exemplary embodiments thereof. It will, however, be evident that various changes and modifications may be made thereunto without departing from the broader spirit and scope of the invention as set forth in the appended claims. The specification and drawings are, accordingly, to be regarded in an illustrative rather than in a restrictive sense.

What is claimed is:

1. In a detector for detecting voltage breakdowns on the high-voltage side of an electric precipitator coupled to the detector, the voltage of the precipitator being supplied from an a-c network through a thyristor control circuit coupled to said a-c network, a high-voltage transformer coupled in series relationship to said thyristor control circuit, and a rectifier coupled in series relationship to said high-voltage transformer, said precipitator being coupled in series relationship to said rectifier, and said detector continuously comparing characteristic parameters of successive half-waves of periodical variations of the voltage at the precipitator, a predetermined deviation between successive characteristic parameters being a criterion for determining a breakdown of the precipitator voltage, the improvement comprising said detector including means for detecting a decrease of the precipitator voltage below a minimum value of the periodical precipitator voltage during continuous operation of said precipitator, said decrease of said precipitator voltage below said minimum value comprising said criterion for determining a breakdown of said precipitator voltage.

2. The improvement recited in claim 1, wherein said detecting means comprises an amplifier having an input terminal thereof coupled to said precipitator, a first resistor coupled to the output terminal of said amplifier, a diode coupled in its forward conduction direction to said resistor, a voltage supply source, a second resistor coupled to said voltage supply source and to said diode and a capacitor coupled to another input terminal of said amplifier and to said diode so that said precipitator voltage corresponds to the voltage across said capacitor when no precipitator voltage breakdown exists, a decrease of said precipitator voltage below said capacitor voltage during continuous operation of said precipitator comprising said criterion for determining a breakdown of said precipitator voltage.

3. The improvement recited in claim 2, wherein said detecting means further comprises a comparator having an input terminal thereof coupled to said capacitor, said diode, and said second resistor, and another input terminal thereof coupled to said precipitator for generating a signal indicating a breakdown of said precipitator voltage.

4. The improvement recited in claim 3, further comprising a potentiometer, coupled to said another terminal of said comparator, for generating a threshold voltage for said comparator so that said comparator generates a signal indicating a breakdown of said precipitator voltage only when said precipitator voltage is less than said capacitor voltage by a predetermined amount.

* * * * *